US009970257B2

(12) United States Patent
Bakken

(10) Patent No.: US 9,970,257 B2
(45) Date of Patent: May 15, 2018

(54) ONE-TRIP METHOD OF PLUGGING A BOREHOLE FOR WELL ABANDONMENT

(71) Applicant: Archer Oil Tools AS, Stavanger (NO)

(72) Inventor: Sverre Bakken, Stavanger (NO)

(73) Assignee: Archer Oils Tools AS, Stavanger (NO)

( * ) Notice: Subject to any disclaimer, the term of this patent is extended or adjusted under 35 U.S.C. 154(b) by 11 days.

(21) Appl. No.: 15/071,409

(22) Filed: Mar. 16, 2016

(65) Prior Publication Data

US 2016/0194934 A1 Jul. 7, 2016

Related U.S. Application Data

(63) Continuation of application No. 13/972,419, filed on Aug. 21, 2013, now Pat. No. 9,334,712.

(51) Int. Cl.

| | |
|---|---|
| ***E21B 33/14*** | (2006.01) |
| ***E21B 33/16*** | (2006.01) |
| ***E21B 37/08*** | (2006.01) |
| ***E21B 33/134*** | (2006.01) |
| ***E21B 33/12*** | (2006.01) |

(Continued)

(52) U.S. Cl.

CPC ..... *E21B 33/14* (2013.01); *E21B 33/12* (2013.01); *E21B 33/134* (2013.01); *E21B 37/00* (2013.01); *E21B 37/08* (2013.01); *E21B 43/11* (2013.01)

(58) Field of Classification Search

CPC ..... E21B 21/103; E21B 33/14; E21B 33/146; E21B 33/16

See application file for complete search history.

(56) References Cited

U.S. PATENT DOCUMENTS

| | | | |
|---|---|---|---|
| 2,512,801 A | 6/1950 | Kinney et al. | |
| 4,279,306 A | 7/1981 | Weitz | |
| 5,484,018 A | 1/1996 | Cavender et al. | |

FOREIGN PATENT DOCUMENTS

| | | | |
|---|---|---|---|
| WO | 2012096580 A1 | 7/2012 | |
| WO | WO 2012096580 A1 * | 7/2012 | ..... E21B 33/13 |

(Continued)

OTHER PUBLICATIONS

Search Report issued in the counterpart Norwegian Patent Application No. NO20131131, dated Mar. 20, 2014 (2 pages).

(Continued)

*Primary Examiner* — Catherine Loikith
(74) *Attorney, Agent, or Firm* — Osha Liang LLP

(57) ABSTRACT

A single trip method allows for perforation, cleaning the annular space around the perforations in an existing tubular and then delivering a sealing material through a combination tool that is used for cleaning and then sealing. For sealing the tool is positioned by the lowermost perforations with a bypass around spaced seals that straddle the outlet port for the sealant. There is an open bypass through the tool and around the spaced seals as the sealant is delivered so that the sealant goes above and below the spaced seals. The open bypass allows the tool to be repositioned as the sealant is delivered. The tool is removed with the string. A separate through passage is selectively opened for removing excess sealant in conjunction with the bypass passages. The sealant can be squeezed with a seal on the string to effectively close the bypass letting pressure through the through passage squeeze.

17 Claims, 8 Drawing Sheets

(51) Int. Cl.
*E21B 37/00* (2006.01)
*E21B 43/11* (2006.01)

(56) References Cited

FOREIGN PATENT DOCUMENTS

| | | | |
|---|---|---|---|
| WO | 2012105852 | A1 | 8/2012 |
| WO | 2013133719 | A1 | 9/2013 |

OTHER PUBLICATIONS

International Search Report issued in the related PCT Application No. PCT/NO2014/050136, dated Oct. 6, 2015 (3 pages).

* cited by examiner

ONE-TRIP METHOD OF PLUGGING A BOREHOLE FOR WELL ABANDONMENT

CROSS-REFERENCE TO RELATED APPLICATIONS

The present application is a continuation of, and therefore claims benefit under 35 U.S.C. § 120 to, U.S. patent application Ser. No. 13/972,419, filed on Aug. 21, 2013.

FIELD OF THE INVENTION

The present invention relates to a method of plugging a petroleum well permanently or temporary, for instance, during a plug and abandonment operation (P&A) or during other operations where setting of a barrier in the well is required, by use of a multitask tool.

BACKGROUND OF THE INVENTION

Petroleum wells for the exploitation of oil and/or gas from a reservoir normally consist of an upper and outer conductor, which forms the base of the well, an upper casing arranged into and in extension of the conductor, and further down in the well more casings which are arranged into and overlaps the above casing. A production tubing string is located in the middle of the well for transporting petroleum from the bottom of the well to the earth's surface or to the sea floor. Annuli will then be formed between the different casings.

Several wells will normally be drilled in a reservoir, where some of these are test wells which are only used for a shorter period prior to the production from the reservoir, and thus will be plugged after testing. If a test well is a successful well, such a well will normally be temporary plugged before the production starts, while a test well which is "dry", i.e. a well in which the hydrocarbon content is too small to be worth producing, will be plugged permanently.

However, as the production from a well gradually falls, all wells will sooner or later have to be abandoned. Before the well is permanently abandoned, the well must be securely plugged, where there are official requirements with respect to how the work is to be carried out and to its completion.

For this purpose normally concrete plugs are used to provide a barrier in the well.

For example, a common requirement during plug and abandonment operations is to have a plug set inside an inner casing string and a further plug set in the annulus between the inner casing string and the outer casing string. The plug will then extend across the full cross sectional area of the well and seal both vertically and horizontally in the well.

In other operations, where setting of a barrier in a well is required, it may be that additional official requirements must be fulfilled.

Other common methods of performing annular sealing during temporary or permanent plugging and abandonment of an oil and/or gas well, all of which have the goal of having the cement placed in the annulus in a secure and safe manner via either holes in the tubular or by directly pumping in the annulus, are as follows: a) so-called shoot and squeeze, which displaces the fluid by use of an open-ended drill pipe or tubing, b) top down cementing, c) circulation squeeze, d) hesitation squeeze.

All of the above methods a)-d) have challenges relating to conforming the cement over the full interval, as it relates both to the placing as well as the logging. The placing of the cement is not conclusive as the cement will have to change place with the annulus fluids present in the annulus prior to placing barrier cement. The fluid which is present in the annulus needs to be evacuated/forced to either above or below the interval or through the formation rock by formation leak-off.

The current logging technologies, e.g. Ultra Sonic Imager Tool (USIT), Cement Bond Log (CBL), Segmented Bond Tool (SBT), have proven very subjective regarding being able to conclusively confirm or verify that the barrier is sealing properly in the annulus. The current designs of today's logging tools are fully dependent on a logging-friendly downhole environment, i.e. the environment needs to fulfill certain demands to be able to perform a proper logging operation.

Document WO 2012/096580 A1 describes a method and washing tool for combined cleaning of an annulus in a well across a longitudinal section of the well, and subsequent plugging of the longitudinal section.

It is, though, a challenge with the solution described in WO 2012/096580 A1, as well as with the other known solutions, that the displacement of the washing fluid by the cement is not satisfactorily. In the worst case, the result is a leaking cement plug. One of the embodiments described in WO 2012/096580 A1 includes dropping of the perforation tool subsequent to the perforation of the well, washing the perforated zone, setting the washing tool at a location in the well, and finally cementing in the perforated zone. Additionally, subsequent to the introduction of the cement, the normally remaining washing fluid that has not been displaced during the cementing operation has to be displaced by pressurizing the cement plug. However, such pressurizing of the cement plug may result in the cement plug not sealing off the well properly, as not only the washing fluid will be forced or squeezed out of the tubular and into the surrounding formation, but also the cement. Furthermore, the cement plug will not be subjected to the same pressure over its length, whereby the cement may not be distributed equally around the periphery of the well.

It is therefore an objective of the present invention to provide a method of plugging a petroleum well permanently or temporary that is more reliable compared with the solutions described in prior art.

More specifically, an objective of the present invention is to provide a solution securing a more reliable and controlled displacement of the fluids, e.g. sealing fluids, present in the annulus in a P&A operation or in other operations where setting of a barrier in the well is required.

Another objective is to provide a method making it possible to perform perforation, washing and cementing in a single trip in the well.

The person skilled in the art will now how to perform the lowering, perforation and washing sequence of the operation. Hence, a detailed description of these operations is not described in the present application. For further information a method including the above mentioned steps (lowering, perforation and washing), e.g. as described in WO 2012/096580 A1, may be applicable in the present invention as well.

The present invention relates to a method of performing a plug and abandonment operation or during other operations where setting of a barrier in the well is required by the use of a multitask tool, for instance a combined perforate and wash tool or just a wash tool, where the tool is used to displace both the washing liquid and the sealing liquid, at least one lower set of sealing arrangement and at least one upper set of sealing arrangement arranged below and above a fluid displacement arrangement, the fluid displacement arrangement comprising a plurality of radial holes, wherein the method comprises the steps of:

a) lowering the tool to the desired location in the well,
b) perforating at least a section of the well if the section is not already perforated,
c) washing said perforated section by pumping washing and/or cleaning fluid through the plurality of radial holes of the displacement arrangement,
d) sealing off a lower portion of the well at a location below the perforated section by the use of the at least one lower set of sealing arrangement,
e) sealing off the well in a lower portion of the perforated section by using the at least one upper set of sealing arrangement,
f) pumping a sealing fluid through the plurality of radial holes of the displacement arrangement,
g) lifting the tool through, and above, the perforated section, while continuing pumping of the sealing fluid.

The lower and upper set of sealing arrangement, being comprised of cups, e.g. swab cups, may comprise one or more individual swab cups for sealing against the surrounding formation, tubular etc.

In an aspect of the preferred embodiment of the invention, the method may further comprise, subsequent to step c), but prior to step d), pulling and lowering the tool for a number of times in the perforated section for performing additional washing of the perforated section.

In an aspect of the preferred embodiment of the invention, the method may further comprise, after step g), a step h) comprising by-passing excess sealing fluid or present annular fluid through a bypass-system bypassing the sealed portions of the well.

In an aspect the bypass-system is arranged in the tool and the sealing fluid or present annular fluid may be lead from the annulus through a second set of openings of the bypass-system, further through the tool and out of a first set of openings of the bypass-system to a location above the sealed portions of the well.

In a preferred embodiment of the method, the tool comprises an internal plugging element, which internal plugging element may be adapted to be activated by means of a remote operation.

In an aspect, the sealing fluid may comprise cement for forming a cement plug. The sealing fluid may also comprise other fluids such as Sandaband®, Thermaset® (Wellcem), Liquid Stone® or similar.

The steps may be performed in a single trip in to the well.

In another embodiment of the method, the steps may be performed in two or more trips in to the well.

In a variation, the washing fluid and the sealing fluid may be pumped through a plurality of radial holes of the displacement arrangement, and the radial holes may be arranged in a spaced-apart relationship around a circumference of the tool.

In a variation, the method may further comprise the step of squeezing present annular fluid or sealing fluid from a location above the sealed portions to a location below the sealed portions in the well by leading the fluids through a first set of openings of a bypass-system above the sealed portions and out of a second set of openings of the bypass-system below the sealed portions.

In a variation, the method may further comprise, after step h), a step i) comprising lifting the tool to a position above the sealing fluid in the well and cleaning the tool by pumping a washing fluid through the tool and the first and second set of openings of the bypass-system.

It shall be clear for the person skilled in the art that the different embodiments and aspects of the invention may be combined in any way, even if they are not explicitly described as one specific embodiment in the described embodiments.

SUMMARY OF THE INVENTION

Cement is placed into the tubular and is then pressurized out of the tubular and into the annulus in a method that displaces the fluid present in the annulus during the cementing sequence of a P&A operation. The method enables a sealing fluid to be placed in the annulus in a safe controlled and confirmable manner. More specifically, the method provides for placement of the sealing fluid in a controlled manner, where the sealing fluid is placed in the desired zone in the well to ensure that the barrier complies with governmental standards as well as other applicable standards.

DETAILED DESCRIPTION OF THE PREFERRED EMBODIMENT

Figure 1:
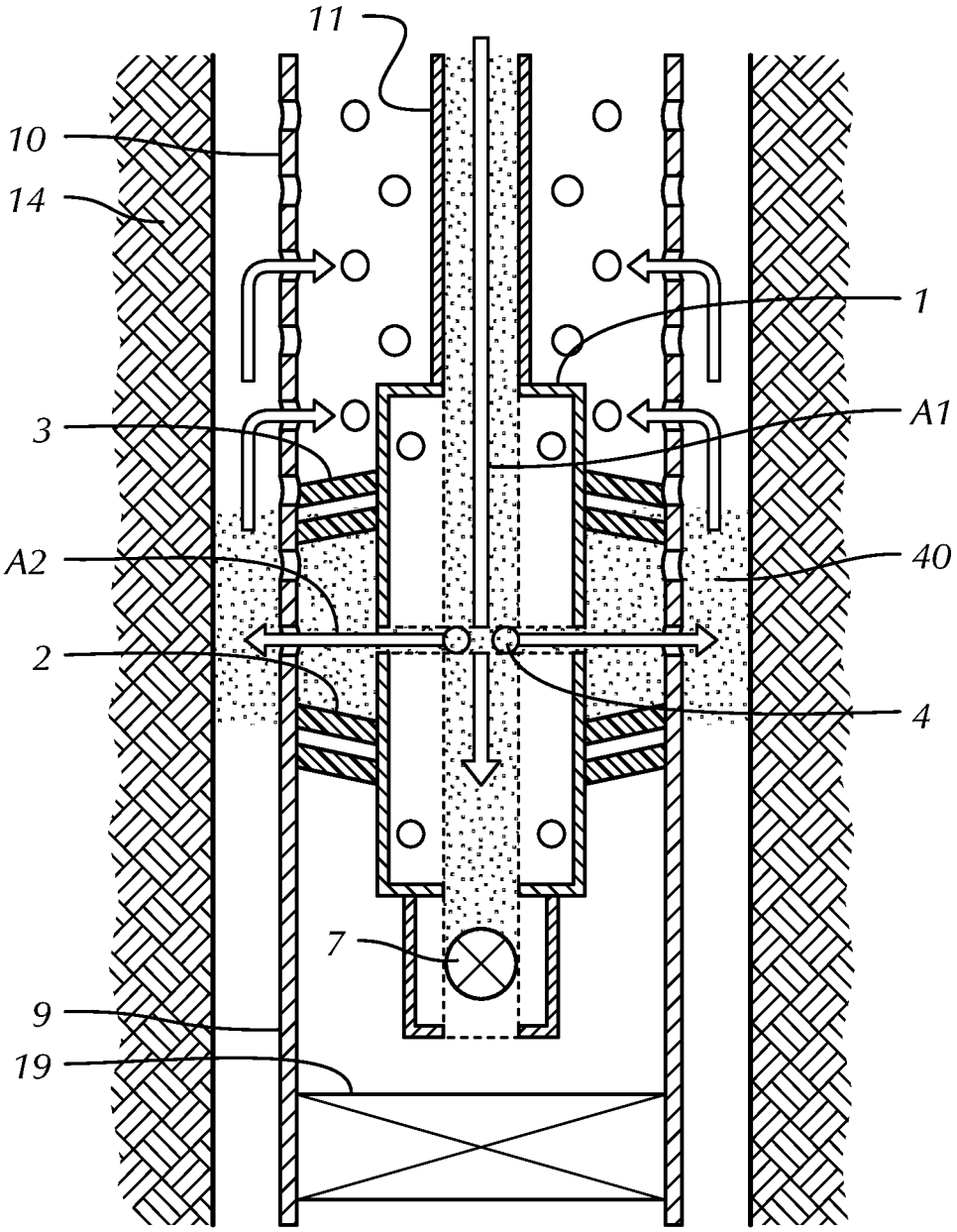
FIGS. 1-7 show a sequence of displacing fluids present in a well annulus by the filling of a sealing fluid that will make sure that pressurized formation areas are isolated and that such formation areas will not leak to surface.
Figure 8:
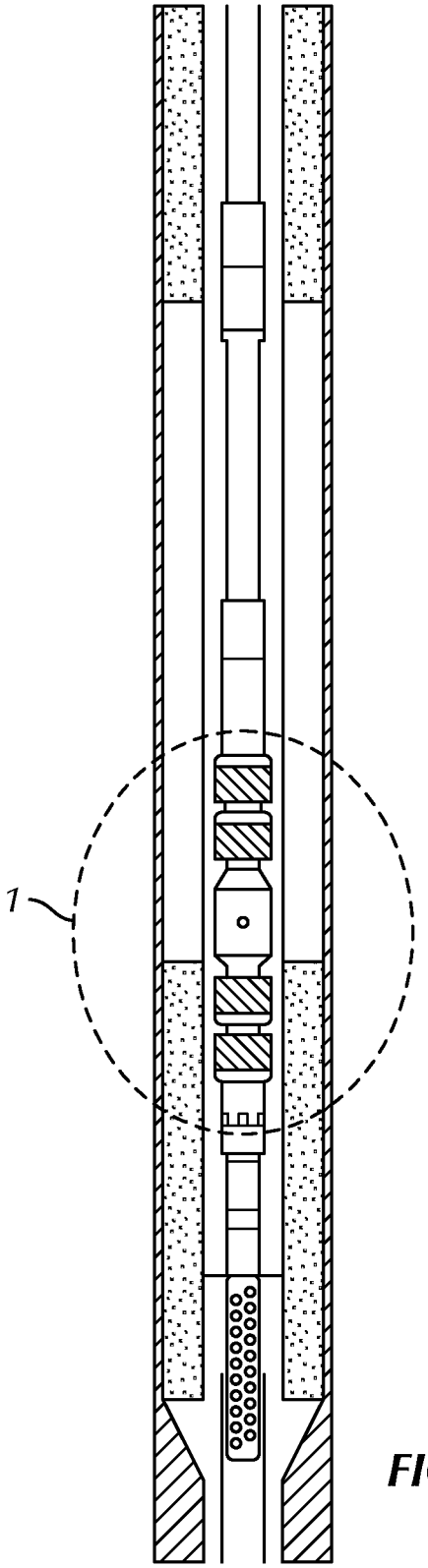
FIG. 8 shows a larger overview of FIG. 1.

FIG. 1 shows the situation after that a desired zone of the well has been perforated with a perforating gun 18, which is shown in FIG. 8 and washed and cleaned with the tool 1. In some locations the perforating gun 18 is not used when there are existing perforations that can be employed for the plugging. Otherwise the perforating gun 18 is run with the tool 1 to make perforations. A packer or bridge plug (not shown) is also located further downhole to support the sealing material to be delivered into the tubular that is perforated above to support the sealant below the perforated section 10. The plug can be run in on the same trip or a different trip as the tool 1 and the perforating gun 18. The combined perforate and wash and seal tool 1 has been lowered in the well until one lower set of sealing arrangements in the form of sealing arrangement 2 is arranged below the lower part of the perforated section 10, the perforated section 10 being indicated by the broken lines, and one upper set of sealing arrangement in the form of sealing arrangement 3 is just above the lower part of the perforated section 10. This allows for circulation of a sealing fluid 40 as indicated by arrows between the lower set of sealing arrangement 2 and the upper set of sealing arrangement 3, and out through a plurality of radial holes 4 arranged between the lower and upper sets of sealing arrangements 2, 3 in the tool 1 from an inside of the tubing 11. The flow pattern is disclosed by the arrows A1, A2, and A3 in the Figures, forcing the sealing fluid 40 from the bottom of the perforated section 10 radially outwardly towards the sidewalls of the casing 9 and perforated section 10, including formation 14, in operation of the tool 1. The tool 1 has an internal plugging device 7 which is closed during this part of the operation.

Figure 2:
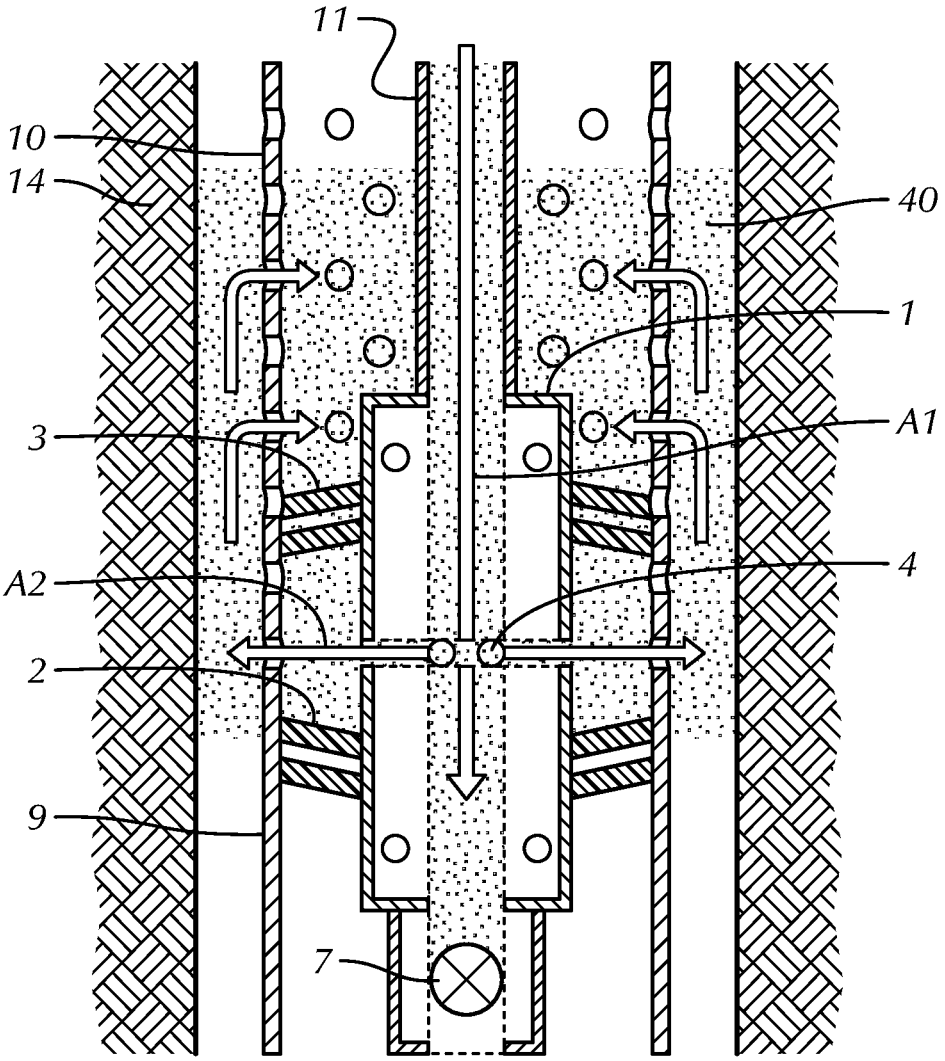

In FIG. 2, the pumping of the sealing fluid, e.g. cement, Thermaset®, Sandaband® or any other fluid, substance or other sealant or similar, has begun. Compared to what is disclosed in FIG. 1, the level of sealing fluid 40 has risen in the well, to a position in which the sealing fluid is at a higher elevation than the tool 1 in the well.

Figure 3:
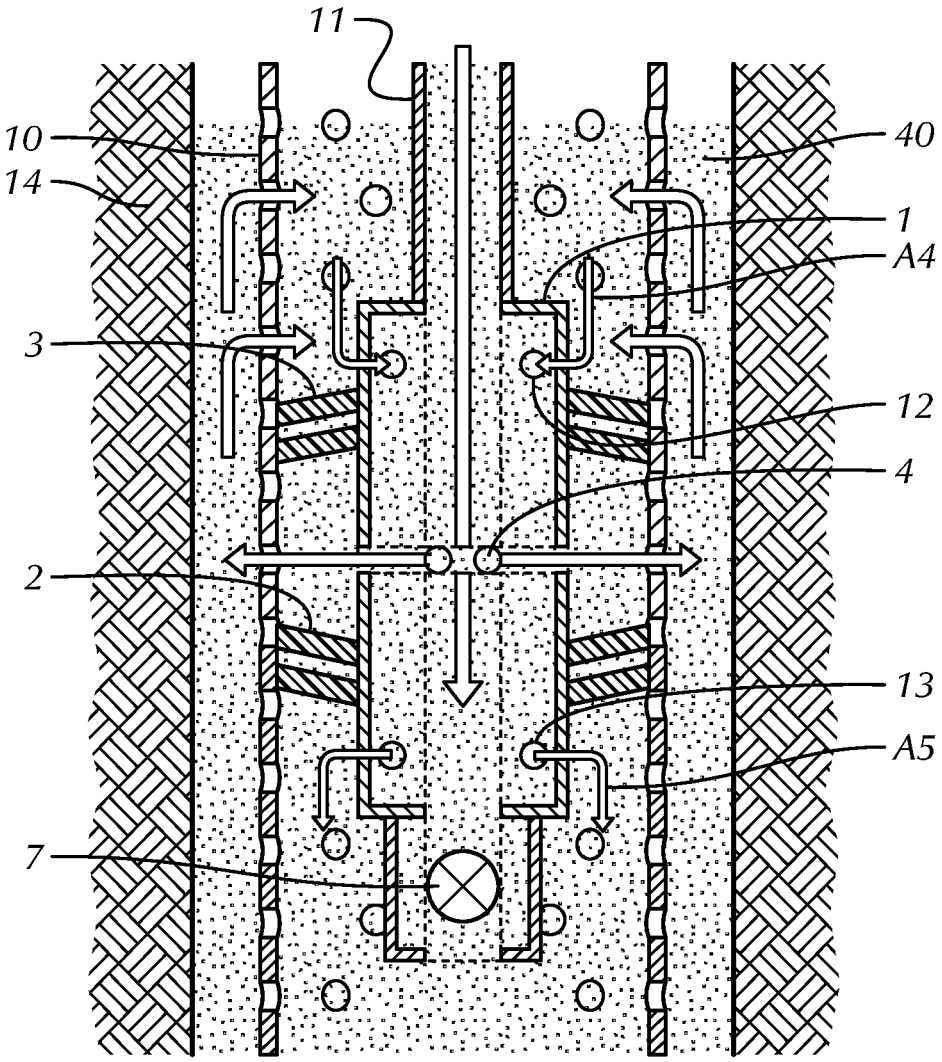

In FIG. 3 the tool 1 has been pulled upwards in a controlled manner while pumping of the sealing fluid 40 has proceeded. The level of the sealing fluid 40 above the tool 1 is held substantially constant. Compared to FIG. 2, the sealing fluid 40 above the perforate and wash tool 1 has begun to fill the tool 1 from the annulus via the perforate and wash tool 1 bypass system, allowing the sealing fluid 40 to fill the void below the perforate and wash tool 1, ensuring solid sealing fluid 40 across the cross sectional area of the perforated section 10. The bypass-system comprises a first set of openings 12 leading from the annulus towards the inside of the tool 1, bypassing the first and second sets of sealing arrangements 2, 3, and ending up in a second set of openings 13 arranged on the other side of the first and second sets of sealing arrangements 2, 3 compared to the first set of openings 12. The by-pass lines extending from the first set of openings 12 to the second set of openings 13, may be separate lines leading from one opening to another opening, or alternatively, one or more common lines for a plurality of openings. As can be seen from FIG. 3, sealing fluid 40 can be "sucked" from above the tool 1 towards the area below the tool 1 due to a change in pressure across the tool, as the tool 1 is pulled towards the surface, leaving an area without sealing fluid. To solve this, the bypass-system allows for sealing fluid 40 to flow through the first set of openings 12 through the tool 1 and out of the second set of openings 13, preventing fluid lock and providing a whole continuous sealing fluid plug in the well (also shown by arrows A4, A5).

Figure 4:
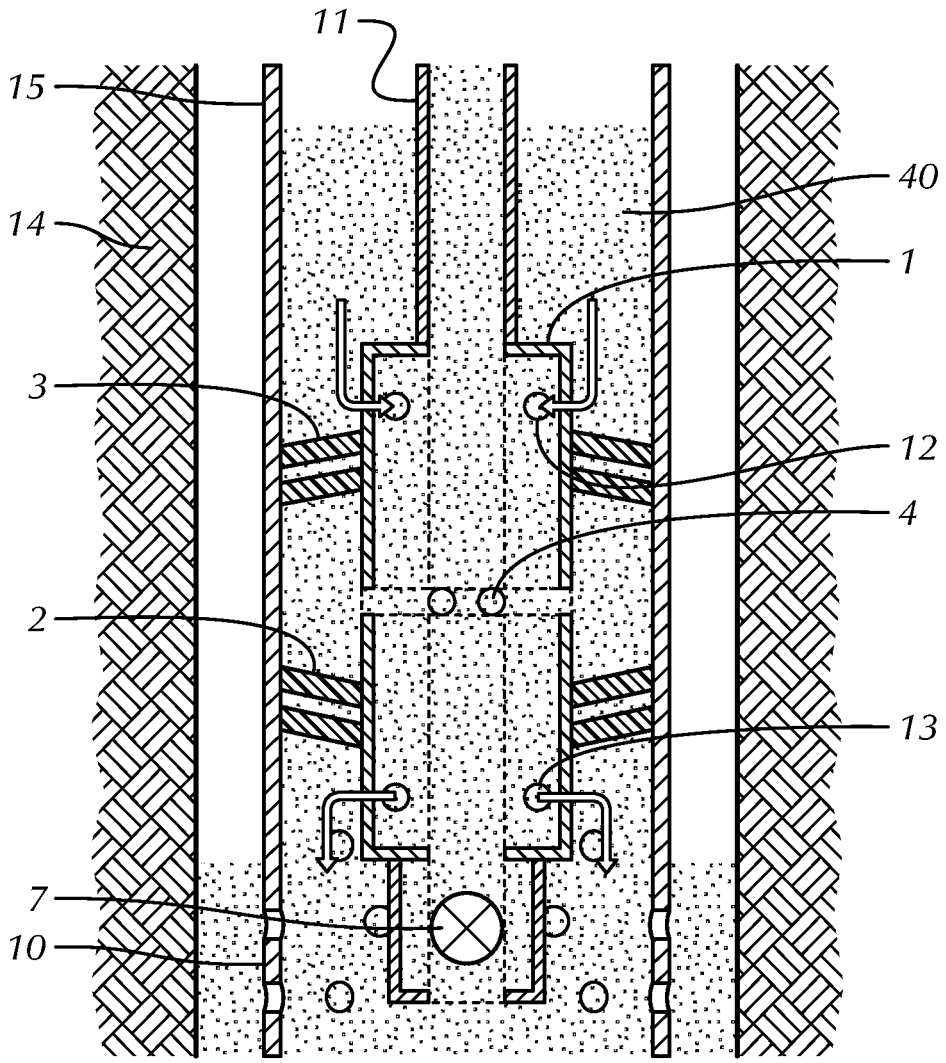

In FIG. 4, a continued pulling of the tool 1 has taken place until the perforate and wash tool 1 has been pulled above the perforated section 10 in the well and positioned inside a non-perforated tubular 15. Now the pumping of sealing fluid is stopped.

Figure 5:
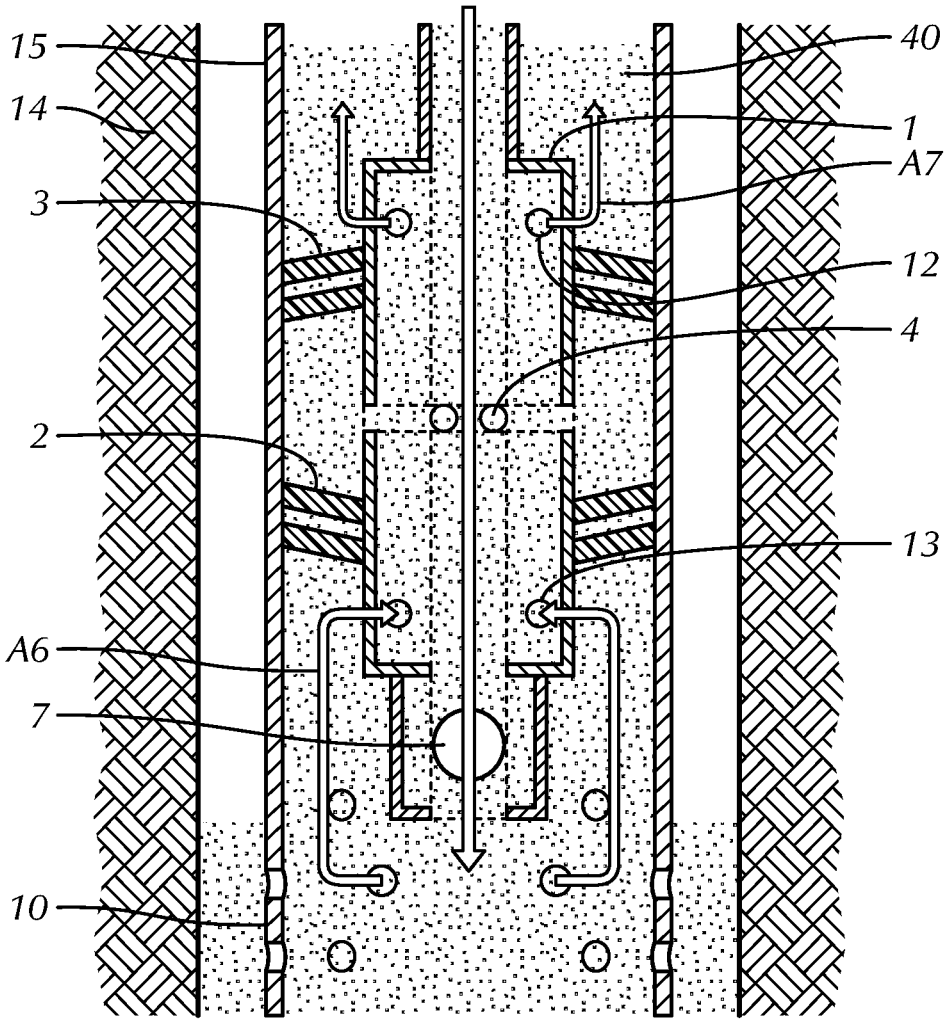

Now referring to FIG. 5 it is disclosed a situation where the internal plugging device 7, which can be opened and closed multiple times, has been opened. This might be done in numerous ways of remote actuation, e.g. electric actuation, hydraulic actuation or by using a ball element, a valve or dart, a mud pulse, cement etc. By opening the internal plugging element 7, the sealing fluid is allowed to be displaced through the tool 1. The bypass-system, which is described in greater detail above, allows for the sealing fluid to be displaced through the bypass-system and up to a location above the tool 1. The displacement of the sealing fluid is disclosed by arrows A6, A7, i.e. in through the second set of openings 13, further through the tool 1 and out of the first set of openings 12. However, it should be understood that the displacement of the sealing fluid may be done the opposite way. The tool 1 is continued to be pulled upwards until the sealing fluid is placed in the well as desired.

Figure 6:
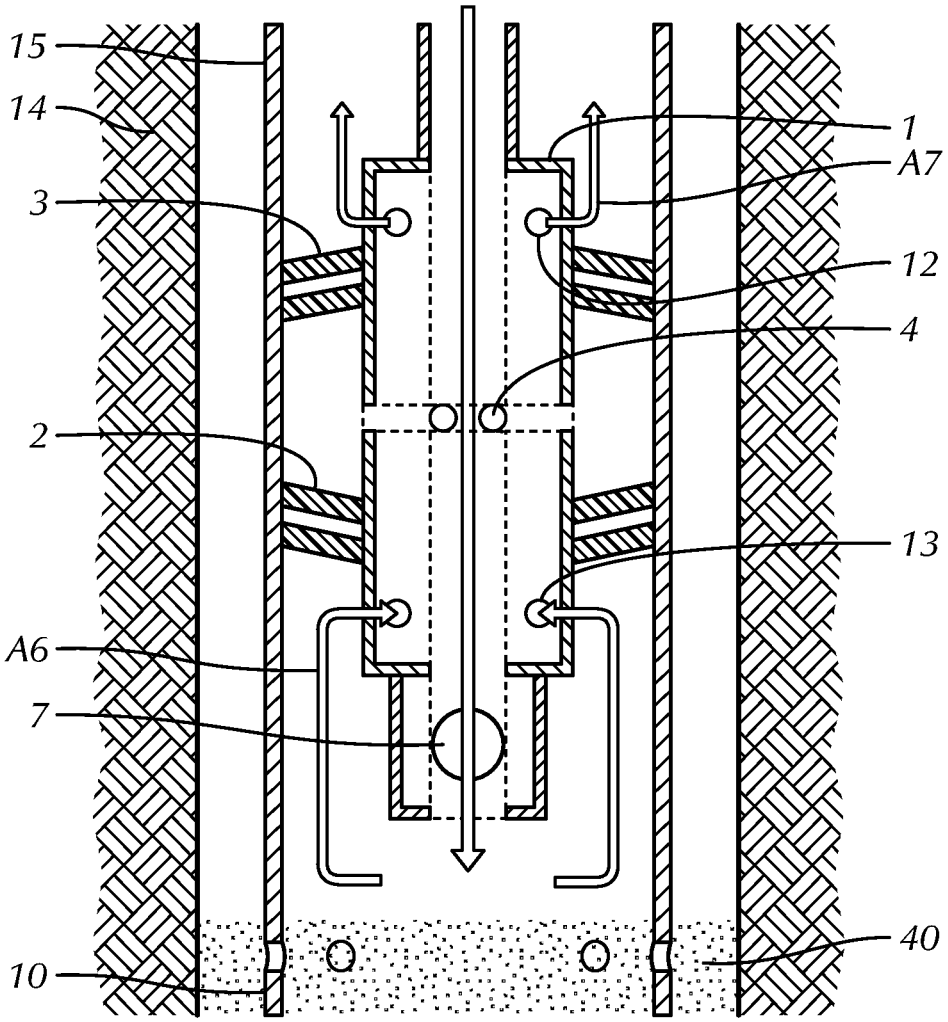

With reference to FIG. 6 the tool 1 has been pulled above the top of the sealing fluid 40. A cleaning process of the tool 1 has been performed, e.g. by pumping washing fluid through the inside of the tubing 11 and down through the tool 1 and the open internal plugging device 7. By this arrangement, wash fluids can flow into the second set of openings 13, up through the tool 1, and out of the first set of openings 12. The cleaning fluid is preferably another fluid than the sealing fluid, and such fluids are known to the person skilled in the art.

Figure 7:
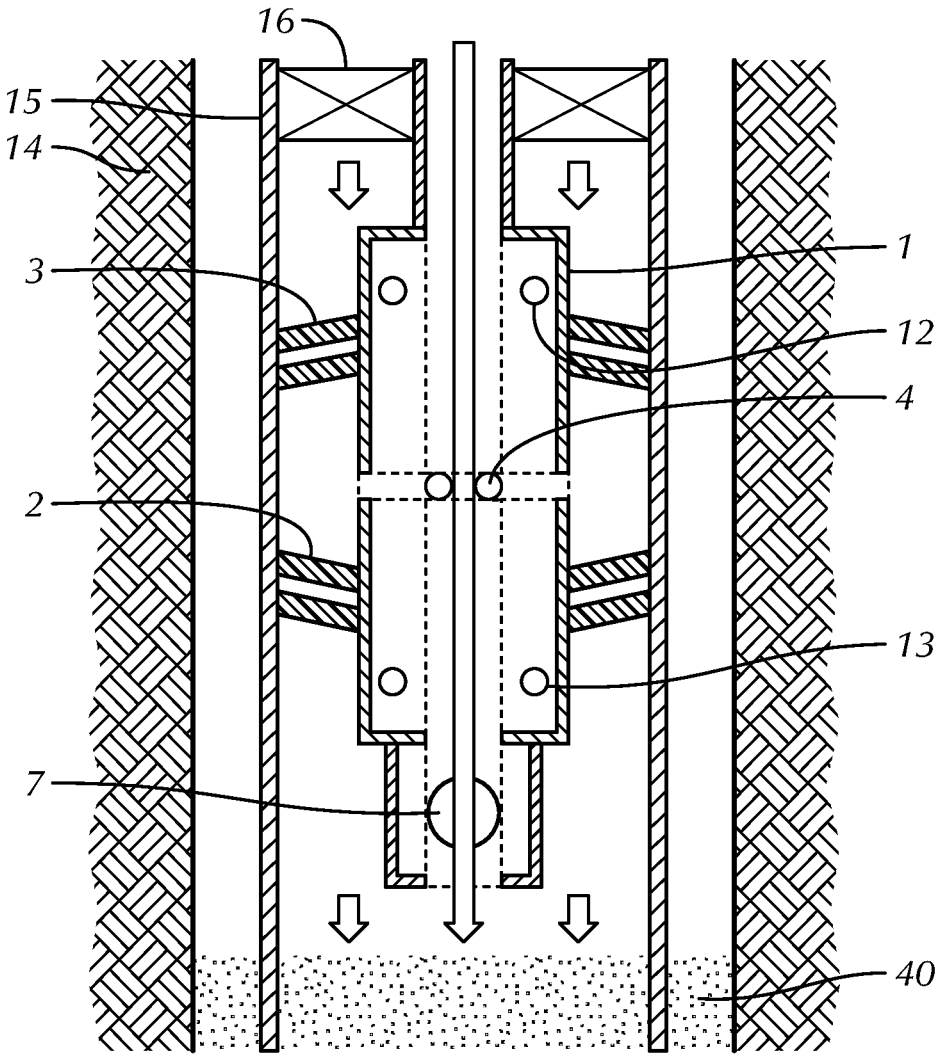

FIG. 7 discloses a situation where it is performed a squeeze of excess fluids in the well. Sealing elements 16 are arranged around the tubing 11 and the squeeze is performed by pushing the tubing 11 and tool 1 downwards into the well. Another way to do this is to be able to close ports 13 so that there is no need for the seal 16 and move the tool downhole, with or without fluid moving through the tool. At the same time a fluid will be run through the tubing 11. Alternatively, the tool 1 can be pulled to the surface instead of squeezing in cases where squeezing of excess fluid is unnecessary.

FIG. 8 discloses an overview of the perforate and wash tool 1 according to the invention arranged in the well, subsequent to that first a perforating operation and thereafter a washing operation have taken place, but prior to that the sealing fluid is pumped into the well.

By the described specific embodiment, at least one of the objectives of the invention is solved. The method makes possible perforation, washing and sealing in one run.

In the preceding description, various aspects of the apparatus according to the invention have been described with reference to the illustrative embodiment. For purposes of explanation, specific numbers, systems and configurations are set forth in order to provide a thorough understanding of the apparatus and its workings. However, this description is not intended to be construed in a limiting sense. Various modifications and variations of the illustrative embodiment, as well as other embodiments of the method, which are apparent to persons skilled in the art to which the disclosed subject matter pertains, are deemed to lie within the scope of the present invention as stated in the attached claims.

I claim:

1. A method comprising:

lowering a wash tool to a desired location in a well;

perforating at least a section of the well if the section is not already perforated;

washing an annular space around the perforated section by pumping a washing fluid and/or a cleaning fluid through a plurality of radial holes of a displacement arrangement of the wash tool;

sealing off a lower portion of the well at a location below the perforated section by using at least one lower set of swab cups of the wash tool, wherein the at least one lower set of swab cups are disposed below the plurality of radial holes;

sealing off the well in a lower portion of the perforated section by using at least one upper set of swab cups of the wash tool, wherein the at least one upper set of swab cups are disposed above the plurality of radial holes;

pumping a cement through the plurality of radial holes of the displacement arrangement and into the annular space;

repositioning the wash tool during the pumping of the cement with a bypass open through the wash tool to facilitate the repositioning; and lifting the wash tool through, and above, the perforated section while continuing the pumping of the cement.

2. The method of claim 1, farther comprising:

removing the wash tool from the well after the pumping of the cement.

3. The method of claim 2, further comprising:

running in at least a perforating device with the wash tool;

perforating at least the section of the well with the perforating device before the washing of the annular space around the perforated section; and positioning the wash tool at perforations furthest from a surface of the well for the onset of the pumping of the cement.

4. The method of claim 3, further comprising:

pumping a sufficient amount of the cement to cover the wash tool while keeping the bypass through the wash tool open during the pumping of the cement.

5. The method of claim 4, wherein the bypass through the wash tool connects spaced regions that are on opposite sides of the wash tool and outside a space between the at least one lower set of swab cups and the at least one upper set of swab cups where the plurality of radial holes are disposed.

6. The method of claim 5, further comprising:

using a bypass through the wash tool to remove excess cement from the wash tool.

7. The method of claim 6, further comprising:

providing a selectively opened through passage through the wash tool; and bypassing the swab cups on the wash tool with displaced excess cement by delivering displacing fluid through the through passage so that the excess cement is displaced around the swab cups through the bypass.

8. The method of claim 7, further comprising:

selectively closing the bypass while selectively opening the through passage to allow pressure application to the delivered cement.

9. The method of claim 8, further comprising:

closing the bypass indirectly with a selectively actuated external seal on a tubular string delivering the wash tool.

10. The method of claim 1, further comprising:

positioning the wash tool at perforations furthest from a surface of the well for the onset of the pumping of the cement.

11. The method of claim 1, further comprising:

pumping a sufficient amount of the cement to cover the wash tool while keeping the bypass through the wash tool open during the pumping of the cement.

12. The method of claim 1, wherein the bypass through the wash tool connects spaced regions that are on opposite sides of the wash tool and outside a space between the at least one lower set of swab cups and the at least one upper set of swab cups where the plurality of radial holes are disposed.

13. The method of claim 1, further comprising:

running in at least a perforating device with the wash tool;

perforating at least the section of the well with the perforating device before the washing of the annular space around the perforated section; and using a bypass through the wash tool to remove excess cement from the wash tool.

14. The method of claim 13, further comprising:

providing a selectively opened through passage through the wash tool; and bypassing the swab cups on the wash tool with displaced excess cement by delivering displacing fluid through the through passage so that the excess cement is displaced around the swab cups through the bypass.

15. The method of claim 1, further comprising:

selectively closing the bypass while selectively opening a through passage to allow pressure application to the delivered cement.

16. The method of claim 15, further comprising:

closing the bypass indirectly with a selectively actuated external seal on a tubular string delivering the wash tool.

17. The method of claim 1, further comprising:

running in at least a perforating device with the wash tool; and perforating at least the section of the well with the perforating device before the washing of the annular space around the perforated section.

* * * * *